US011523492B2

(12) United States Patent
Mitra et al.

(10) Patent No.: US 11,523,492 B2
(45) Date of Patent: Dec. 6, 2022

(54) ADJUSTABLE LENGTH CONSUMABLES FOR A LIQUID-COOLED PLASMA ARC TORCH

(71) Applicant: Hypertherm, Inc., Hanover, NH (US)

(72) Inventors: Soumya Mitra, Lebanon, NH (US); Jeremy Beliveau, Cornish, NH (US); John Peters, Canaan, NH (US); Stephen M. Liebold, Grantham, NH (US)

(73) Assignee: Hypertherm, Inc., Hanover, NH (US)

( * ) Notice: Subject to any disclaimer, the term of this patent is extended or adjusted under 35 U.S.C. 154(b) by 43 days.

(21) Appl. No.: 16/840,973

(22) Filed: Apr. 6, 2020

(65) Prior Publication Data

US 2020/0323075 A1 Oct. 8, 2020

Related U.S. Application Data

(60) Provisional application No. 62/829,080, filed on Apr. 4, 2019.

(51) Int. Cl.
*H05H 1/34* (2006.01)
*H05H 1/28* (2006.01)

(52) U.S. Cl.
CPC ..... *H05H 1/34* (2013.01); *H05H 1/28* (2013.01); *H05H 1/3447* (2021.05); *H05H 1/3457* (2021.05); *H05H 1/3468* (2021.05); *H05H 1/3478* (2021.05)

(58) Field of Classification Search
None
See application file for complete search history.

(56) References Cited

U.S. PATENT DOCUMENTS 3,740,522 A 6/1973 Muehlberger
4,891,490 A * 1/1990 Labrot ..... H05H 1/34 219/121.48
5,856,647 A 1/1999 Luo
7,989,727 B2 8/2011 Twarog et al.
8,624,150 B2 1/2014 Simek et al.
8,981,253 B2 3/2015 Shipulski et al.
(Continued)

FOREIGN PATENT DOCUMENTS

JP 2005209363 A 8/2005
WO 2006100936 A1 9/2006
(Continued)

*Primary Examiner* — Ibrahime A Abraham
*Assistant Examiner* — Elizabeth M Kerr
(74) *Attorney, Agent, or Firm* — Cesari and McKenna, LLP

(57) ABSTRACT

A torch tip is provided for a liquid-cooled plasma arc cutting torch. The torch tip includes an electrode with an elongated electrode body having a distal end and a proximal end extending along a longitudinal axis. The electrode body includes at least one interior threaded connection at the proximal end for engaging a liquid-cooled electrode holder. The electrode holder comprises a liquid coolant channel that does not extend into the electrode body. The electrode body has (i) a length extending along the longitudinal axis and (ii) a diameter associated with a widest portion of the electrode body along the longitudinal axis between the proximal and distal ends, where a ratio of the length to the diameter of the electrode body is greater than about 5.

9 Claims, 7 Drawing Sheets

(56) References Cited

U.S. PATENT DOCUMENTS

| | | | | |
|---|---|---|---|---|
| 10,194,516 | B2 | 1/2019 | Schulze et al. | |
| 10,638,591 | B2 | 4/2020 | Peters | |
| 2003/0052095 | A1 | 3/2003 | Sanders et al. | |
| 2008/0083708 | A1 * | 4/2008 | Hussary | H05H 1/34 219/121.5 |
| 2008/0217305 | A1 * | 9/2008 | Sanders | H05H 1/28 219/121.49 |
| 2014/0144892 | A1 * | 5/2014 | Hussary | H05H 1/34 219/121.51 |
| 2014/0291303 | A1 * | 10/2014 | Hollberg | H05H 1/34 219/121.52 |
| 2017/0188445 | A1 * | 6/2017 | Yamaguchi | H05H 1/28 |

FOREIGN PATENT DOCUMENTS

| | | | | |
|---|---|---|---|---|
| WO | 2016060840 | A1 | 4/2016 | |
| WO | WO-2016060840 | A1 * | 4/2016 | H05H 1/34 |

* cited by examiner

ADJUSTABLE LENGTH CONSUMABLES FOR A LIQUID-COOLED PLASMA ARC TORCH

CROSS REFERENCE TO RELATED APPLICATION

This application claims the benefit of and priority to U.S. Provisional Patent Application No. 62/829,080 filed Apr. 4, 2019, the entire content of which is owned by the assignee of the instant application and is incorporated herein by reference in its entirety.

TECHNICAL FIELD

The present invention generally relates to consumables for a liquid-cooled plasma arc torch, and more specifically, to extended access consumables for a liquid-cooled plasma arc torch.

BACKGROUND

Plasma arc torches are widely used for high temperature processing (e.g., cutting, welding, and marking) of metallic materials. A plasma arc torch generally includes a torch body, an electrode mounted within the body, an emissive insert disposed within a bore of the electrode, a nozzle with a central exit orifice, a shield, electrical connections, passages for cooling and arc control fluids, a swirl ring to control the fluid flow patterns, and a power supply. The plasma arc torch can produce a plasma arc, which is a constricted, ionized jet of plasma gas with high temperature and high momentum. Gases used in the torch can be non-reactive (e.g., argon or nitrogen) or reactive (e.g., oxygen or air).

A plasma arc torch can generate a plasma arc using a contact start method. This involves first operating the torch in a pilot arc mode, which includes establishing physical contact and electrical communication between the electrode and the nozzle, e.g., by using a biasing force from, for example, a spring. A current path and a small pilot arc current flow are established between the electrode and the nozzle while they are biased together. A plasma gas is introduced into a plasma chamber between the nozzle and the electrode, such that gas pressure builds up in the plasma chamber to break the physical contact between the electrode and the nozzle to separate the two components. The separation causes an electrical arc to be created in the gap between the electrode and the nozzle in the plasma chamber. The electrical arc ionizes the flowing plasma gas in the plasma chamber to produce a plasma arc (i.e., a pilot arc). The plasma gas can be passed through a swirl ring to impart a tangential motion to the gas as it passes through the torch, thereby improving torch performance. Next, in a transferred arc mode, the torch is moved near a grounded workpiece and the plasma arc makes contact with the workpiece. Upon contact, the current return path transfers from the nozzle to the workpiece, which means that the electrical return path from the nozzle is opened (i.e., electrically disconnected) and the current returns instead from the workpiece back to the power supply. During transferred arc mode, the current flow can be increased to a larger amount such that the arc generated processes (e.g., gouging, piercing or cutting) of the workpiece.

Currently, dimensions of a plasma arc torch are determined by the size and configuration of the consumables discussed above, e.g., the electrode, swirl ring, nozzle, and shield. Design of these consumables is highly technical and has a dramatic impact on torch life and performance. The electrode is generally surrounded by a swirl ring, a nozzle, and in some configurations a shield. All of these components, and the manner in which they are designed and combined, affect the overall torch dimensions, configuration, weight, cost and other parameters.

Furthermore, plasma arc torches are now being used in ever more intricate cutting operations, including those where access to portions of the workpiece can be difficult. Standard torches, due to their dimensions, may not be usable in hard-to-reach areas such as channels, sharp corners and pockets. FIGS. 1*a* and 1*b* show the positioning of a conventional plasma arc torch 100 in relation to a vertical flange 102 to be cut and the resulting cut 104 made by the conventional plasma arc torch 100, respectively. As illustrated, the vertical flange 102 is perpendicularly located relative to a horizontal base 108 to create a corner 110. Due to the dimensions of the conventional plasma arc torch 100, the torch tip 106 of the plasma arc torch 100 is unable to be positioned sufficiently close to the corner 110 between the vertical flange 102 and the horizontal base 108 to cut the flange 102 as close as possible against the base 108 without damaging the flange 102. Instead, as shown from the resulting cut 104 of FIG. 1*b*, a diagonal cut is made into the flange 102 below the base 108, thereby unintentionally damaging the flange 102.

Another torch design consideration is that standard plasma arc torches, such as the torch 100 of FIGS. 1*a* and 1*b*, cannot run at a high percentage duty cycle without melting the torch components and causing other temperature-related problems in the torch. This is because torch consumables (e.g., the electrode, nozzle, swirl ring and shield) are exposed to high temperatures during operation. Torch consumables can be cooled utilizing various techniques, such as water injection cooling to cool the nozzle and/or shield, liquid cooling in the electrode and/or about nozzle, or gas cooled at vent holes to cool the shield as described in U.S. Pat. No. 5,132,512. However, cooling of plasma arc torch consumables can become more difficult when the plasma arc torch is run at high currents (e.g., greater than about 15 Amps) and/or when the plasma arc torch is entirely gas cooled.

FIG. 2 shows a known liquid cooling path 250 in a conventional liquid-cool plasma arc torch 200. As shown, a liquid coolant is first introduced to the torch tip via a coolant tube 216 that is inserted into a cavity 206 the electrode 205. The coolant flow 250 travels distally within the coolant tube 116 and exits into the cavity 206 of the electrode 205 at a distal opening of the coolant tube 216. As guided by the wall of the cavity 206, the coolant flow 250 is adapted to reverse direction and travel proximally along the outer surface of the coolant tube 116 within the cavity 206 to cool the length of the electrode 205. To cool the nozzle 210, the coolant flow 250 exits from the cavity 206 of the electrode 205 via a passage 207 that is disposed in the torch body 202 connected to the electrode 205, and reverses direction to travel distally to reach the nozzle 210. To cool the shield 225, the same coolant flow 250 exits from the nozzle 210 via a passage 211 of the nozzle 210 that is in fluid communication with an inner surface of the shield 225. Thereafter, this coolant flow 250 travels proximally to return to the torch body 202 along the inner surface of an outer retaining cap 218 that is connected to the shield 225. Such zig-zag, back-and-forth pattern of the liquid coolant flow, which comprises the coolant flow alternating several times between distal and proximal flows, is typical of a conventional liquid-cooled plasma arc torch.

SUMMARY

What is needed is a set of consumables in a liquid-cooled plasma arc torch that is designed for plasma cutting in deep channels, tight spaces, and hard-to-reach corners. In some embodiments, the present invention provides an adapter (hereinafter interchangeably referred to as an "extender') for liquid-cooled plasma arc torches that is configured to operably connect to a set of extended and/or adjustable-length consumables. The use of such an extender and consumable set is advantageous because they minimize overall torch thickness while enabling high-access, long-range plasma cutting. Further, a combination of liquid and gas cooling schemes can be utilized to cool different portions of the plasma arc torch so as to provide adequate cooling for the torch during cutting operations and prevent premature failure of the consumables.

The present invention, in one aspect, features a torch tip for a liquid-cooled plasma arc cutting torch. The torch tip includes an electrode with an elongated electrode body having a distal end and a proximal end extending along a longitudinal axis. The electrode body includes a bore at the distal end for receiving a hafnium insert and at least one interior threaded connection at the proximal end for engaging a liquid-cooled electrode holder. The electrode holder comprises a liquid coolant channel that does not extend into the electrode body. The electrode body has (i) a length extending along the longitudinal axis and (ii) a diameter associated with a widest portion of the electrode body along the longitudinal axis between the proximal and distal ends. A ratio of the length to the diameter of the electrode body is greater than about 5. The torch tip also includes a nozzle having a substantially hollow, elongated nozzle body for receiving the electrode. The nozzle body defines (i) a length extending along the longitudinal axis and (ii) a diameter associated with a widest portion of the nozzle body along the longitudinal axis. A ratio of the length to the diameter of the nozzle body is greater than about 1.75

In some embodiments, the diameter of the electrode is less than about 0.25 inches. In some embodiments, the ratio of the length to the diameter of the electrode body is greater than about 7.

In some embodiments, the at least one threaded connection is configured to engage a complementary threaded connection on an external surface of the electrode holder, such that a distal portion of the electrode holder is disposed in a cavity of the electrode body upon engagement. In some embodiments, the cavity within the electrode body is shaped and sized to substantially surround a protruding boss portion at the distal portion of the electrode holder, thereby axially and radially aligning the electrode relative to the electrode holder.

In some embodiments, the torch tip further comprises a shield coupled to the nozzle via an insulator. In some embodiments, the shield includes a set of radially-oriented passages dispersed around a first circumference of the shield. The radially-oriented passages fluidly connect an exterior surface to an interior surface of the shield and configured to impart a swirling motion on a first portion of a combined gas flow therethrough. The shield can also include a set of axially-oriented passages dispersed around a second circumference of the shield. The axially-oriented passages are configured to axially conduct a second portion of the combined gas flow over an external surface of the shield. In some embodiments, the set of axially-oriented passages of the shield comprises at least one groove disposed on the exterior surface of the shield.

In some embodiments, the combined gas flow at the torch tip comprises a combination of a plasma gas flow and a shield gas flow. In some embodiments, the nozzle comprises a set of radially-oriented passages each connecting an interior surface of the nozzle body to an exterior surface of the nozzle body. The set of radially-oriented passages of the nozzle is configured to fluidly communicate with the radially-oriented and axially-oriented passages of the shield to supply a portion of the plasma gas flow to the shield. In some embodiments, the torch tip, including the electrode, the shield and the nozzle, is substantially cooled by at least one of the plasma gas flow, the shield gas flow or the combined gas flow without being cooled by a liquid coolant in the liquid coolant channel of the electrode holder.

In another aspect, the invention features an extender of a liquid-cooled plasma arc torch for relocating a mounting location of at least one plasma torch consumable within the torch. The extender is located between a torch body and the at least one consumable. The extender includes an elongated body defining a longitudinal axis between a proximal end and a distal end, a liquid cooling passage extending substantially along the longitudinal axis of the elongated body, a proximal interface at the proximal end of the elongated body configured to matingly engage the torch body, and a distal interface at the distal end of the elongated body configured to enable the at least one consumable to mount thereon, such that the mounting location for the at least one consumable is extended in a spaced relationship relative to the proximal interface along the longitudinal axis.

In some embodiments, the at least one consumable comprises the electrode, and the distal interface of the elongated body is configured to engagingly hold the electrode mounted to the distal end of the elongated body. In some embodiments, the at least once consumable further comprises a nozzle coupled to the electrode and a shield coupled to the nozzle via an insulator component.

In some embodiments, a cavity is disposed in the elongated body and configured to receive, via the proximal interface, a liquid coolant tube of the torch body that forms the liquid cooling passage within the elongated body. In some embodiments, the liquid coolant tube extends along a first portion of the elongated body and is absent from a remaining portion of the elongated body. A diameter of the first portion of the elongated body can be less than about 1 inch. In some embodiments, the remaining portion defines a spaced distance along the longitudinal axis between a distal end of the coolant tube and a proximal end of the electrode upon assembly of the plasma arc torch. This spaced distance can be about 1.25 inches.

In some embodiments, a set of radial passages is located within the remaining portion of the extender, where each radial passage is in fluid communication with the coolant tube and configured to fluidly connect an interior surface of the extender to an exterior surface to convey the liquid coolant away from the extender.

In some embodiments, the distal interface of the elongated body comprises a protruding boss portion configured to form a tolerance fit with a complementarily-shaped cavity at a proximal end of the electrode to axially and radially align the electrode upon engagement.

In some embodiments, the elongated body of the extender comprises (i) an electrode holder configured to engage an electrode, (ii) a nozzle holder substantially surrounding an exterior surface of the electrode holder, the nozzle holder configured to engage a nozzle, and (iii) a shield holder substantially surrounding an exterior surface of the nozzle holder, the shield holder configured to engage a shield. In some embodiments, the elongated body of the extender further comprises a swirl ring holder located radially between the exterior surface of the electrode holder and an interior surface of the nozzle holder, where the swirl ring holder is configured to engage a swirl ring.

In yet another aspect, the present invention features a method for liquid cooling a plasma arc cutting torch comprising a torch body, an extender and a torch tip. The torch body is connected to a proximal end of the extender and the torch tip is connected to a distal end of the extender. The extender is elongated such that a length to diameter ratio of the extender is greater than about 5. The method includes conveying a liquid coolant from the torch body to the extender via a coolant tube of the torch body that is inserted into a cavity of the extender upon engagement of the torch body with the proximal end of the extender. The method also includes returning the liquid coolant to the torch body without circulating the liquid coolant to the torch tip. The method further includes conveying one or more gases to the torch tip to cool the torch tip.

In some embodiments, the torch tip comprises an electrode, a nozzle surrounding an exterior surface of the electrode, and a shield surrounding an exterior surface of the nozzle. In some embodiments, the extender comprises an electrode holder to physically engage the electrode to the torch body, a nozzle holder to physically engage the nozzle to the torch body, and a shield holder to physically engage the shield to the torch body, the electrode holder. The nozzle holder and the shield holder are concentrically positioned relative to each other about a longitudinal axis of the torch.

In some embodiments, conveying one or more gases to the torch tip comprises providing a plasma gas flow to travel distally between an exterior surface of the electrode and an interior surface of the nozzle and conducting, by a set of radially-oriented passages in the nozzle, at least a portion of the plasma gas flow from the interior surface of the nozzle to an exterior surface of the nozzle. The method also includes providing a shield gas flow to travel distally over the exterior surface of the nozzle and combining the portion of the plasma gas flow and the shield gas flow at the exterior surface of the nozzle to generate a combined gas flow. The plasma gas flow, the shield gas flow and the combined gas flow are adapted to cooperatively cool the electrode, the nozzle and the shield at the torch tip. The method can further include providing a first portion of the combined gas flow to a channel between the exterior surface of the nozzle and an interior surface of the shield, within which the first portion of the combined gas flow is adapted to travel distally toward a shield exit orifice while cooling both the shield and the nozzle. The method can further include conducting, by a set of axially-oriented grooves disposed on an external surface of the shield, a second portion of the combined gas flow over the external surface of the shield to cool the shield.

In some embodiments, providing a first portion of the combined gas flow to a channel between the nozzle and the shield comprises conducting, by a set of radially-oriented passages disposed in the shield, the first portion of the combined gas flow from an external surface of the shield into the channel. In some embodiments, the set of radially-oriented passages disposed in the shield are configured to impart a swirling motion to the first portion of the combined gas flow therethrough.

In some embodiments, returning the liquid coolant to the torch body without circulating the liquid coolant to the torch tip includes (i) conducting the liquid coolant away from the extender via a set of radially-oriented passages located in a central portion of the extender, each radially-oriented passage connecting an interior surface of the extender to an external coolant channel defined by an exterior surface of the extender and an interior surface of a nozzle holder, and (ii) conveying, by the external coolant channel, the liquid coolant proximally toward the torch body to return the liquid coolant to the torch body.

In yet another aspect, the present invention features a method for liquid cooling a plasma arc cutting torch comprising a torch body, an extender and a torch tip including a plurality of consumable components. The torch body is connected to a proximal end of the extender and the torch tip is connected to a distal end of the extender. The method includes conveying a liquid coolant from the torch body to the extender via a coolant tube of the torch body that is inserted into a cavity of the extender upon engagement of the torch body with the proximal end of the extender. The liquid coolant flows distally from the torch body to the extender within the coolant tube. The method also includes conducting, by a set of liquid passages in the extender, the liquid coolant radially outward from an interior surface of the extender to an external coolant channel defined by an exterior surface of the extender and an interior surface of a nozzle holder. The method further includes conveying, by the external coolant channel, the liquid coolant proximally toward the torch body to return the liquid coolant to the torch body. Both the coolant tube and the external coolant channel are longitudinally spaced from the torch tip such that the liquid coolant is substantially absent from the torch tip. In some embodiments, the method further includes providing one or more gases to cool the plurality of consumable components in the torch tip.

BRIEF DESCRIPTION OF THE DRAWINGS

The advantages of the invention described above, together with further advantages, may be better understood by referring to the following description taken in conjunction with the accompanying drawings. The drawings are not necessarily to scale, emphasis instead generally being placed upon illustrating the principles of the invention.

DETAILED DESCRIPTION

Figure 3:
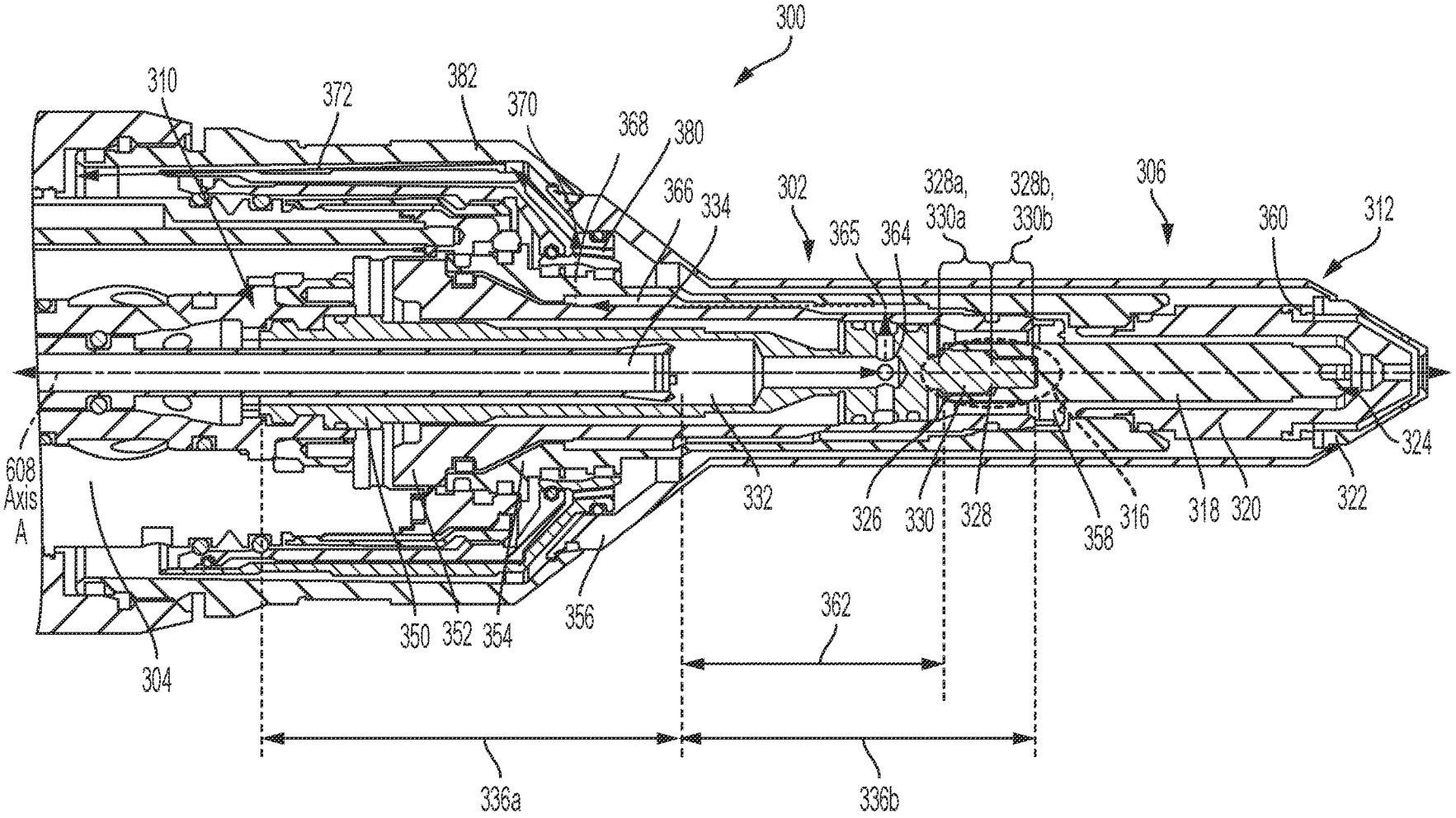
FIG. 3 shows a cross-sectional view of an exemplary liquid-cooled plasma arc torch that includes an extender operably connect to a set of one or more adjustable/extended-length consumables, according to some embodiments of the present invention.

FIG. 3 shows a cross-sectional view of an exemplary liquid-cooled plasma arc torch 300 that includes an extender 302 operably connected to a set of one or more adjustable/extended-length consumables, according to some embodiments of the present invention. As shown, the extender 302 is generally located between a torch body 304 of the plasma arc torch 300 and the set of consumables at a torch tip 306 of the plasma arc torch 300. The extender 302 has an elongated body that includes at least one of an electrode holder 350, a swirl ring holder 352, a nozzle holder 354 and a shield holder 356. The elongated body of the extender 302 defines a longitudinal axis A between a proximal end 310 and a distal end 312, where the distal end 312 is the end that is closest to a workpiece during torch operation and the proximal end 310 is opposite of the distal end. The set of consumables at the torch tip 306 of the plasma arc torch 300 that can be coupled to the extender 302 includes one or more of an electrode 318, a nozzle 320 and a shield 322. In some embodiments, the extender 302 and torch tip 306 are configured to operate at a high amperage (e.g., greater than about 55 Amps, about 60 Amps, about 70 Amps, about 110 Amps, about 115 Amps, or about 170 Amps) and extend the cutting reach of liquid-cooled plasma arc torch 300 into hard to reach areas to cut materials with a thickness greater than about ¾ of an inch (e.g., about 1 inch, about 1.5 inches, or about 2 inches).

In some embodiments, the proximal end 310 of the elongated body of the extender 302 is configured to matingly engage the torch body 304 via a proximal interface that includes, for example, a threaded connection between the torch body 304 and the extender 302. The distal end 312 of the elongated body of the extender 302 is configured to matingly engage the one or more consumables of the torch tip 306 via a distal interface. The extender 302 has an extended length along the longitudinal axis A such that it extends and relocates the engagement/mounting locations of the consumables in a spaced relationship relative to the proximal interface at which the torch body 304 is connected. In some embodiments, at the distal end 312 of the extender 302, the electrode holder 350, the swirl ring holder 352, the nozzle holder 354 and the shield holder 356 of the extender 302 are configured to physically engage the electrode 318, a swirl ring 358, the nozzle 320 and the shield 322, respectively. Thus, the extender 302 functions as a holder to physically retain various consumables of the torch tip 306 at its distal end 312 while extending their mounting locations relative to the torch body 304. As shown, the electrode holder 350, the swirl ring holder 352, the nozzle holder 354 and the shield holder 356 can be concentrically disposed relative to each other about the central longitudinal axis A. For example, the swirl ring holder 352 can substantially surround an exterior surface of the electrode holder 350, the nozzle holder 354 can substantially surround an exterior surface of the swirl ring holder 352, and the shield holder 356 can substantially surround an exterior surface of the nozzle holder 354.

In some embodiments, the electrode holder 350 is configured to engage and hold the electrode 318, where the electrode 318 can also be elongated (i.e., has an elongated body) along the longitudinal axis A. The elongated body of the electrode 318 can be defined by (i) a length extending along the longitudinal axis A between the distal end 324 and the proximal end 326 of the electrode 318, and (ii) a diameter associated with the widest portion of the electrode body along the longitudinal axis A. The distal end 324 of the electrode body includes a bore for receiving a hafnium insert. In some embodiments, the length of the electrode body is variable, such as greater than about 1.75 inches (e.g., about 4.75 inches, about 7.75 inches or about 8.75 inches). In some embodiments, the diameter of the electrode body is less than about 0.25 inches (e.g., 0.245 inches). In some embodiments, the ratio of the length to the diameter of the electrode body is greater than about 5, such as greater than about 7.

The proximal end 326 of the electrode 318 and the distal end of the electrode holder 350 of the extender 302 are configured to physically engage with each other, such that the proximal end 326 of the electrode body is mounted onto the distal end of the electrode holder 350. For example, the proximal end 326 of the electrode body can include at least one interior thread (not shown) disposed along the wall of a cavity 328 within the electrode body, where the opening of the cavity 328 is exposed at the proximal end 326 of the electrode 318. The cavity 328 is configured to receive a distal portion 330 of the electrode holder 350. Specifically, the thread on the wall of the cavity 328 is configured to engage a complementary thread (not shown) on an external surface of the distal portion 330 of the electrode holder 350 after the distal portion 330 is inserted into the cavity 328.

In some embodiments, the cavity 328 of the electrode body comprises two portions, a wider portion 328*a* located proximal to a narrower portion 328*b*. Specifically, the width of the wider portion 328*a* along a radial axis (that is perpendicular to the longitudinal axis A) is larger than the width of the narrower portion 328*b*. Similarly, the distal portion 330 of the electrode holder 350 of the extender 302 can have a wider part 330*a* adjacent to a protruding boss part 330*b* that is narrower in width (along the radial axis) than that of the wider part 330*a*. The threaded connections can be disposed on the respective ones of the wider cavity portion 328*a* and the wider electrode holder part 330*a* to enable the threaded engagement of the two components as described above. The narrower cavity portion 328*b* of the electrode 318 can be shaped and sized to snuggly receive and substantially surround the protruding boss part 330*b* of the electrode holder 350 (e.g., via a tolerance fit), which further axially and radially aligns the electrode 318 relative to the extender 302 while providing extra rigidity to the connection. This additional alignment minimizes physical contact (e.g., ensures no physical contact) between the distal end 324 of the electrode 318 and the inner surface of the nozzle 320 while the electrode 318 is suspended within the hollow body of the nozzle 320. In alternative embodiments, the threads can be disposed on the narrower portion 328*b* of the electrode 318 and the narrower part 330*b* of the electrode holder 350 to facilitate thread engagement between the two components, while the wider portion 328*a* of the electrode 318 and the wider part 330*a* of the electrode holder 350 have the alignment surfaces for aligning the two components relative to each other.

The proximal end of the electrode holder 350 is configured to matingly engage the torch body 304 so that the electrode holder 350 is able to retain the electrode 318 against the torch body 304. In some embodiments, a cavity 332 is formed in the elongated body of the electrode holder 350 with an opening to the cavity 332 exposed at the proximal end 310. The cavity 332 of the electrode holder 350 is configured to receive and house at least a portion of a liquid coolant tube 334 of the torch body 304. The liquid coolant tube 334 conducts a liquid coolant flow distally along the longitudinally axis A within the cavity 332 of the electrode holder 350, thus providing a liquid cooling path in the interior of the elongated body of the electrode holder 350. In some embodiments, the liquid coolant tube 334 only extends through a first portion 336*a* of the electrode holder body and is absent from the remaining portion 336*b* of the electrode holder body. In some embodiments, a diameter of the first portion 336*a* (along a radial axis perpendicular to the longitudinal axis A) within which the coolant tube extends is less than about 1 inch. Further, the cavity 332 within which the coolant tube 334 is inserted does not extend through the entire length of the remaining portion 336 of the electrode holder 350, but terminates proximate to a set of radial passages 364 in the remaining portion 336. Thus the remaining portion 336*b* of the body of the electrode holder 350 spaces the liquid coolant tube 334 and the cavity 332 from the electrode 318 upon assembly of the plasma arc torch, such that the liquid coolant tube 334 and the cavity 332 do not extend into the body of the electrode 318. In some embodiments, a spaced distance 362 along the longitudinal axis A between the distal end of the coolant tube 334 and the proximal end 326 of the electrode 318 within the torch 300 is about 1.25 inches. In some embodiments, a spaced distance along the longitudinal axis A between the radial passages 364 (i.e., the distal end of the cavity 332) and the proximal end 326 of the electrode 318 is about 0.2 inches to about 0.3 inches. In some embodiments, a spaced distance along the longitudinal axis A between the distal end of the coolant tube 334 and the radial passages 364 is about 0.3 inches (e.g., about 0.25 inches or about 0.15 inches).

In some embodiments, the swirl ring holder 352 of the extender 302 is configured to engage the swirl ring 358 of the torch tip 306. As shown in FIG. 3, the swirl ring 358 substantially surrounds an exterior surface of the electrode 318 at the torch tip 306, where swirl ring 358 is configured to impart a swirling motion to a plasma gas flow therethrough. The swirl ring holder 352 is configured to (i) engage the swirl ring 358 at the distal end of the swirl ring holder 352 (ii) engage the torch body 304 at the proximal end of the swirl ring holder 352, and (iii) substantially surround the electrode holder 350 in a radially-spaced relationship within the extender 302. Therefore, the swirl ring holder 352 is able to axially and radially align the swirl ring 358 relative to the electrode 318 while retaining the swirl ring 358 against the torch body 304. In some embodiments, the swirl ring 358 is pre-assembled into the extender 302, such as coupled to the swirl ring holder 352, prior to attaching other consumables (e.g., the electrode 318, the nozzle 320 and/or the shield 322) to the distal end of the extender 302 to assemble the torch 300. In some embodiments, the swirl ring holder 352 and the nozzle holder 354 are permanently connected/assembled/joined as a single extender.

In some embodiments, the nozzle holder 354 of the extender 302 is configured to engage the nozzle 320 of the torch tip 306, where the nozzle 320 can also be elongated (i.e., has an elongated body) along the longitudinal axis A. The elongated nozzle body can be defined by a length extending along the longitudinal axis A and a diameter associated with the widest portion of the nozzle body along the longitudinal axis A. In some embodiments, the ratio of the length to the diameter of the nozzle body is greater than about 1.75. For example, the length of the nozzle body can be variable, such as about 1.45 inches, about 4.45 inches, about 7.45 inches, or about 8.45 inches. The diameter of the nozzle body can be less than about 0.6 inches (e.g., 0.58 inches).

The nozzle body is substantially hollow to receive at least a portion of the electrode 318, while maintaining a spaced relationship relative to the portion of the electrode 318 disposed therein. Such radial and axial alignment of the nozzle 320 relative to the electrode 318 can be at least partly provided by the nozzle holder 354, which is configured to engage the nozzle 320 at its distal end, engage the torch body 304 at its proximal end, and substantially surround the swirl ring holder 352 (which surrounds the electrode holder 350) within the extender 302.

In some embodiments, the shield holder 356 of the extender 302 is configured to engage the shield 322 of the torch tip 306. As shown in FIG. 3, the shield 322 has a substantially hollow body configured to receive at least a portion of the nozzle 320. The shield holder 356 is configured to (i) engage the shield 322 at the distal end of the shield holder 356 (ii) engage the torch body 304 at the proximal end of the shield holder 356, and (iii) substantially surround the nozzle holder 356 in a radially-spaced relationship within the extender 302. Therefore, the shield holder 356 is able to axially and radially align the shield 322 relative to the nozzle 320 while retaining the shield 322 against the torch body 304.

Figure 4:
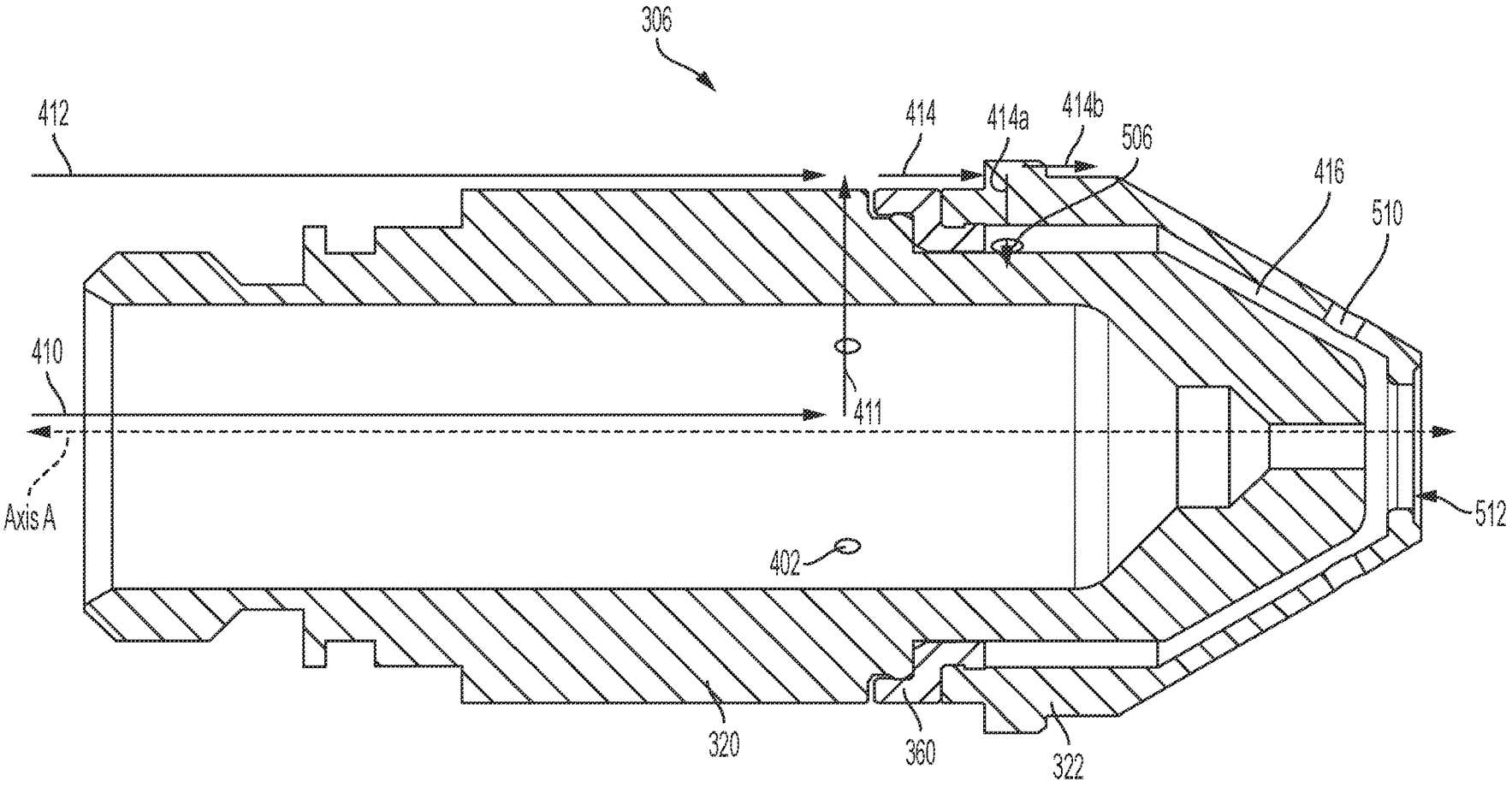
FIG. 4 shows a sectional-view of a portion of the torch tip of FIG. 3 that includes the nozzle and the shield, according to some embodiments of the present invention.

FIG. 4 shows a sectional-view of a portion of the torch tip 306 of FIG. 3 that includes the nozzle 320 and the shield 322, according to some embodiments of the present invention. As shown, the nozzle 320 can have a set of passages 402 disposed along a circumference of the nozzle 320, where the passages 402 can be located proximal to the shield 322 along the longitudinal axis A. The set of nozzle passages 402 can be radially-oriented to conduct a plasma gas from the interior surface of the nozzle 320 to the exterior surface of the nozzle 320. Details regarding this gas flow will be described below in detail. The shield 322 substantially surrounds a distal portion of the nozzle 320 and is coupled to the nozzle 320 via an insulator 360 disposed therebetween. The insulator 360 can be made from an electrically insulating material to provide electrical insulation between the shield 322 and the nozzle 320. Additionally, the insulator 360 can provide thermal insulation between the shield 322 and the nozzle 320 for balancing and isolating heat loads. Further, the insulator 360 physically spaces the shield 322 from the nozzle 320 to create a channel 416 therebetween for gas flows, which will be described in detail below. In some embodiments, the nozzle 320 and the shield 322 are coupled together via the insulator 360, where the resulting combination is installed onto the distal end of the extender 302, such as retained by the shield holder 356 of the extender 302 and aligned by the combination of the nozzle holder 354 and the shield holder 356.

Figure 5B:
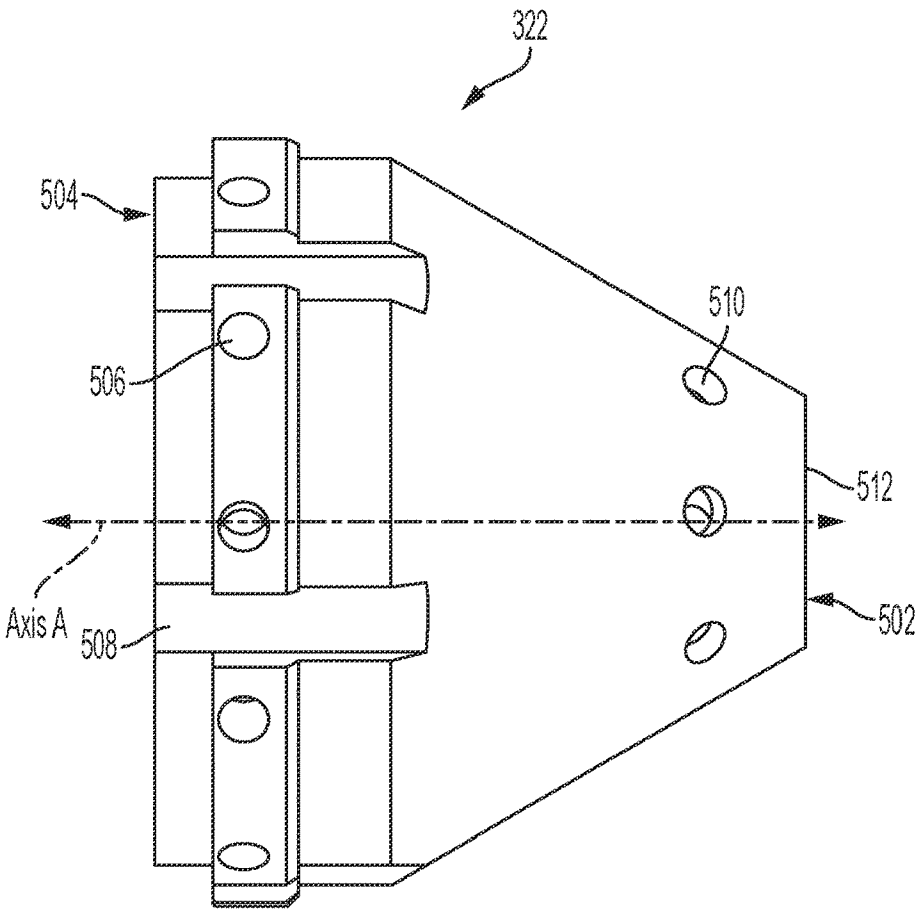
FIGS. 5*a* and 5*b* show a perspective view and a profile view, respectively, of the shield of FIG. 4, according to some embodiments of the present invention.
Figure 5A:
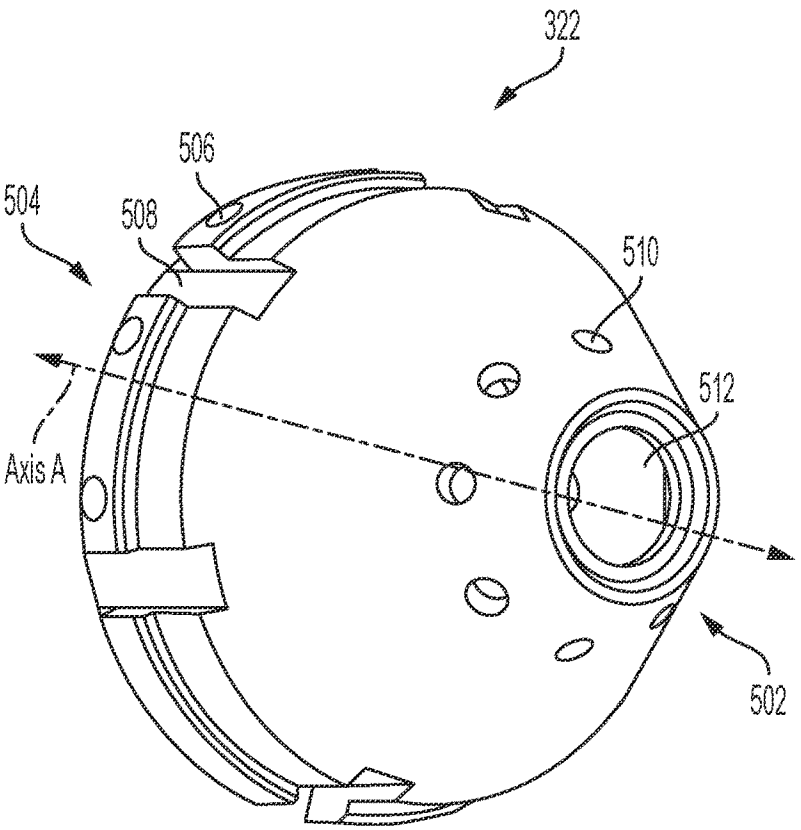

FIGS. 5*a* and 5*b* show a perspective view and a profile view, respectively, of the shield 322 of FIG. 4, according to some embodiments of the present invention. As shown, the shield 322 has a substantially hollow body extending between a distal end 502 and a proximal end 504. The proximal end 504 of the shield 322 can include a set of radially-oriented passages 506 dispersed around a first circumference of the shield 322. The radially-oriented passages 506 are configured to fluidly connect an exterior surface of the shield 322 to an interior surface of the shield 322 and impart a swirling motion on a gas flow therethrough. Additionally, the shield 322 can include a set of axially-oriented passages 508 dispersed around a second circumference of the shield 322. The axially-oriented passages 508 can be one or more grooves etched into the external surface of the shield 322. These axially-oriented passages 508 are configured to axially conduct, along the longitudinal axis A, a gas flow over the external surface of the shield 322 from the proximal end 504 to the distal end 502. In some embodiments, the axially-oriented passages 508 are interspersed with the radially-oriented passages 506 around a circumference of the proximal end 504 of the shield 322. Further, the shield 322 can include a set of vent passages 510 disposed at the distal end 502 of the shield 322 close to a shield exit orifice 512. Details regarding gas flows through these passages 504, 508 and 510 will be provided below.

Referring back to the plasma arc torch 300 of FIG. 3, in some embodiments, the torch 300 includes one or more retaining components to further retain the consumables of the torch tip 306 to the extender 302 and/or the extender 302 to the torch body 304. For example, an inner retaining cap 380 can be disposed between the nozzle holder 354 and the shield holder 356, where the inner retaining cap 380 is configured to retain the nozzle holder 354 and the components that are either directly or indirectly attached to the nozzle holder 354 (e.g., the electrode holder 350, the swirl ring holder 352, the electrode 318, the swirl ring 358 and/or the nozzle 320), to the torch body 304. In some embodiments, an outer retaining cap 382 can be disposed over the inner retaining cap 380 and configured to retain the shield holder 356 (hence the shield 322 connected to the shield holder 356) to the torch body 304. The inner retaining cap 380 and/or the outer retaining cap 382 can be components of the extender 302 or stand-alone components separate from the extender 302.

In another aspect, the plasma arc torch 300 of FIG. 3 is configured to minimize (e.g., prevent) liquid cooling of the torch tip 306. Instead, the torch tip 306, which includes the electrode 318, the nozzle 320 and the shield 322, can be gas cooled by one or more gases introduced to the torch tip 306. In some embodiments, the coolant tube 334 of the torch body 304 conveys a liquid coolant to the extender 302 upon insertion of the coolant tube 334 into the cavity 332 of the electrode holder 350 of the extender 302 at its proximal end. However, the extender 302 is configured to return the liquid coolant to the torch body 304 without the coolant being circulated to the torch tip 306.

FIG. 3 illustrates an exemplary coolant flow path 680 within the torch 300. As shown, the liquid coolant conveyed by the coolant tube 334 is adapted to flow distally within the cavity 332, through the first portion 336*a* of the electrode holder 350 (within which the coolant tube 334 is inserted). Upon exiting the coolant tube 334, the coolant flow 680 is released into the cavity 332 and flows distally through only a section of the remaining portion 336*b* of the electrode holder 350. This is because the cavity 334 does not extend through the entire length of the remaining portion 336 and thus does not conduct the liquid coolant to the electrode 318. Instead, upon entering the remaining portion 336*b* of the electrode holder 350 within the cavity 332, the coolant flow 680 encounters the set of radial passages 364 that are located within the remaining portion 336*b* and spaced from the proximal end 326 of the electrode 318. The cavity 332 is configured to terminate at the set of radial passages 364 within the remaining portion 336*b*. Each radial passage 364 is in fluid communication with the cavity 332 and connects an interior surface of the electrode holder 350 to an exterior surface of the electrode holder 350. Each radial passage 364 can be radially oriented (i.e., along a radial axis perpendicular to the longitudinal axis A) to convey the liquid coolant flow 680 in the cavity 332 radially away from the electrode holder 350 and into the swirl ring holder 352. In some embodiments, liquid cooling within the electrode holder 350 is confined to a region of less than one inch in diameter (e.g., the cavity 332 has a diameter of less than one inch at its widest section).

Upon exiting the electrode holder 350 and entering a region between the electrode holder 350 and the swirl ring holder 352, the coolant flow 680 is adapted to immediately exit the swirl ring holder 352 via one or more radial passages 365 disposed in the body of the swirl ring holder 352 and axially aligned with the radial passages 364 of the electrode holder 350. Each radial passage 365 of the swirl ring holder 352 is adapted to connect an interior surface to an exterior surface of the swirl ring holder 352. Upon exiting from the swirl ring holder 352, the coolant flow 680 is adapted to travel proximally toward the torch body 304 in an axially-oriented channel 366 defined by the external surface of the swirl ring holder 352 and the internal surface of the nozzle holder 354. In some embodiments, one or more radial passages 368 are disposed in the body of the nozzle holder 354, where each radial passage 368 connects an interior surface to an exterior surface of the nozzle holder 354. Further, one or more radial passages 370 can be disposed in the body of the inner retaining cap 380, where each radial passage 370 connects an interior surface to an exterior surface of the inner retaining cap 380. The passages 368 in the nozzle holder 354 and the passages 370 in the inner retaining cap 380 can be axially aligned with each other, but positioned proximal to the radial passages 364, 365 in the electrode holder 350 and the swirl ring holder 352. In operation, the radial passages 368, 370 are in fluid communication with the channel 366 between the swirl ring holder 352 and the nozzle holder 354 to conduct the liquid coolant flow 680 radially away from the nozzle holder 354 and into an axially-oriented channel 372 between an exterior surface of the inner retaining cap 380 and an interior surface of the outer retaining cap 382. The coolant flow 680 is adapted to travel proximally within this channel 372 to return to the torch body 304.

Thus, the liquid coolant flow 680 does not make contact with the electrode 318 or other components in the torch tip 306, such as the swirl ring 358, the nozzle 320 and/or the shield 322, before being returned to the torch body 304. This U-shaped flow path 680 is different from the coolant flow path 250 in the prior art plasma arc torch 200 of FIG. 2, where the coolant flow 250 travels in a zig-zag, back-and-forth fashion to contact cool the electrode 205, the nozzle 210 and the shield 225 before being returned to the torch body along the outer retaining cap 218. In alternative embodiments, the liquid coolant flow 680 extends completely through electrode holder 350, passing through cavity sections 328*a* and 328*b* to contact and/or enter a portion of electrode 318.

In some embodiments, the various consumable components in the torch tip 306 of the plasma arc torch 300 are cooled by one or more gases. With reference to FIG. 4, a plasma gas flow 410 can be provided to the nozzle 320 between an interior surface of the nozzle 320 and an exterior surface of the electrode 318 (not shown in FIG. 4). The plasma gas flow 410 travels distally within the nozzle 320 toward the set of passages 402 disposed along a circumference of the nozzle 320. The set of nozzle passages 402 can be radially-oriented to divert at least a portion 411 of the plasma gas flow 410 from an interior surface to an exterior surface of the nozzle 320. In addition, a shield gas flow 412 can be provided to travel distally toward the shield 322 over an exterior surface of the nozzle 320. The diverted plasma gas flow 411 and the shield gas flow 412 are adapted to combine at the exterior surface of the nozzle 320 to form a combined gas flow 414 that travels distally toward the shield exit orifice 512 over an exterior surface of the shield 322. In general, the diverted plasma gas flow 411, the shield gas flow 412 and the combined gas flow 414 can cooperatively cool various consumable components of the torch tip 306, including the electrode 318, the nozzle 320 and the shield 322.

In some embodiments, the combined gas flow 414 cools the shield 322 and the nozzle 320 as it travels distally toward the shield exit orifice 512. As shown in FIG. 4, a portion 414*a* of the combined gas flow 414 is adapted to enter the set of radially-oriented passages 506 of the shield 322 from an exterior surface of the shield 322 to an interior surface of the shield 322. Thereafter, the combined gas flow portion 414*a* flows distally through a channel 416 formed between the exterior surface of the nozzle 320 and the interior surface of the shield 322. This distal flow 414*a* is adapted to cool both the nozzle 320 and the shield 322 as it travels through the channel 416 and exits via the shield exit orifice 512. In some embodiments, the set of radially-oriented passages 506 are configured (e.g., canted) to impart a swirling motion to the combined gas flow portion 414*a* therethrough. In some embodiments, a portion of the distal flow portion 414*a* in the channel 416 can be vented to atmosphere via the vent passages 510 to further facilitate shield cooling. In addition, another portion 414*b* of the combined gas flow 414 is configured to flow through the set of axially-oriented passages 508 (shown in FIGS. 5*a* and 5*b*), such as in the form of one or more grooves etched into the external surface of the shield 322. These passages 508 are configured to axially conduct, along the longitudinal axis A, the combined gas flow portion 414*b* over the external surface of the shield 322 from the proximal end 504 to the distal end 502 to cool the external surface of the shield 322.

As explained above, the radially-oriented passages 402 of the nozzle 320 are in fluid communication with the radially-oriented passages 506 and axially-oriented passages 508 of the shield 322 to propagate the diverted plasma gas flow 411 and facilitate gas cooling at the torch tip 306. Further, the torch tip 306 can be substantially cooled by at least one of the plasma gas flow 411, the shield gas flow 412 or the combined gas flow 414 (including gas flows 414*a* and 414*b*) without being cooled by a liquid coolant in the coolant tube 334 of the electrode holder 350. Thus, the plasma arc torch 300 can have a hybrid cooling configuration that includes liquid cooling of the extender 302 and gas cooling of the torch tip 306.

In some embodiments, the plasma arc torch 300 is adapted to generate a plasma arc using a contact start method. In alternative embodiments, the plasma arc torch 300 can initiate a plasma arc using a high-frequency, high-voltage (HFHV) method, as is known in the art. For example, the plasma arc torch 300 can generate a pilot arc using a pilot arc current supplied from a power supply (not shown) to the torch 300, where the pilot arc current is associated with a HFHV signal.

Figure 6:
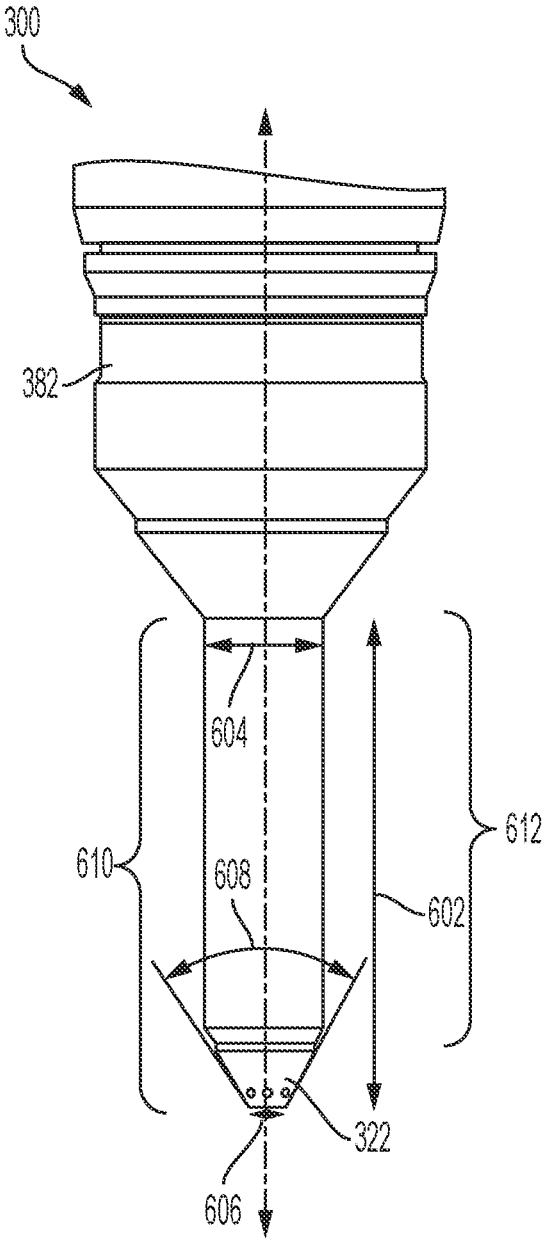
FIG. 6 shows a profile view of the plasma arc torch of FIG. 3, according to some embodiments of the present invention.

FIG. 6 shows a profile view of the plasma arc torch 300 of FIG. 3, according to some embodiments of the present invention. As shown, the combination of the extender 302 and the consumables elongate the overall length of the torch 300 along the longitudinal axis A while reducing the width/thickness of the torch 300 at the tip portion 612. The length (L) 602 of a distal portion 610 of the torch 300, which includes the narrow tip portion 612 of the extender 302 and the shield 322 after assembly, can be about 3 inches. However, the lengths of the extender 302 and/or the consumable components, such as the electrode 318, the nozzle 322 and/or the shield 322, can be extended to any desirable dimension to adapt to any desirable application. For example, the length L 602 of the distal portion 610 can be greater than 3 inches, such as 6 inches, 9 inches or 10 inches, or any desired length. To achieve a length L 602 of 3 inches, the length of the electrode can be 1.75 inches and the length of the nozzle can be 1.45 inches. To achieve a length L 602 of 6 inches, the length of the electrode can be 4.75 inches and the length of the nozzle can be 4.45 inches. To achieve a length L 602 of 9 inches, the length of the electrode can be 7.75 inches and the length of the nozzle can be 7.45 inches. To achieve a length L 602 of 10 inches, the length of the electrode can be 8.75 inches and the length of the nozzle can be 8.45 inches. In some embodiments, the length of the extender 302 is variable and can be selected to achieve a desired overall length of the torch and/or accommodate certain features of the consumable component(s) attached to the extender 302. For example, if the electrode 318 and nozzle 320 are extended, then the shield holder 356 also needs to be extended to hold together these components and retain them to the torch body 304. In addition, one or more of the nozzle holder 354, the swirl ring holder 352, or the electrode holder 350 can be lengthened as well. Further, the extender 302 and/or the consumables at the torch tip 306 can be easily engaged and disengaged from the torch body 304 in order to achieve the combination with the desired overall length. For example, a shorter torch 300 with a shorter extender 302 can be used for a more beveled cut while a longer extender 302 can be used to cut larger flanges. Such interchangeability increases the versatility of plasma arc torch usage.

Figure 1A:
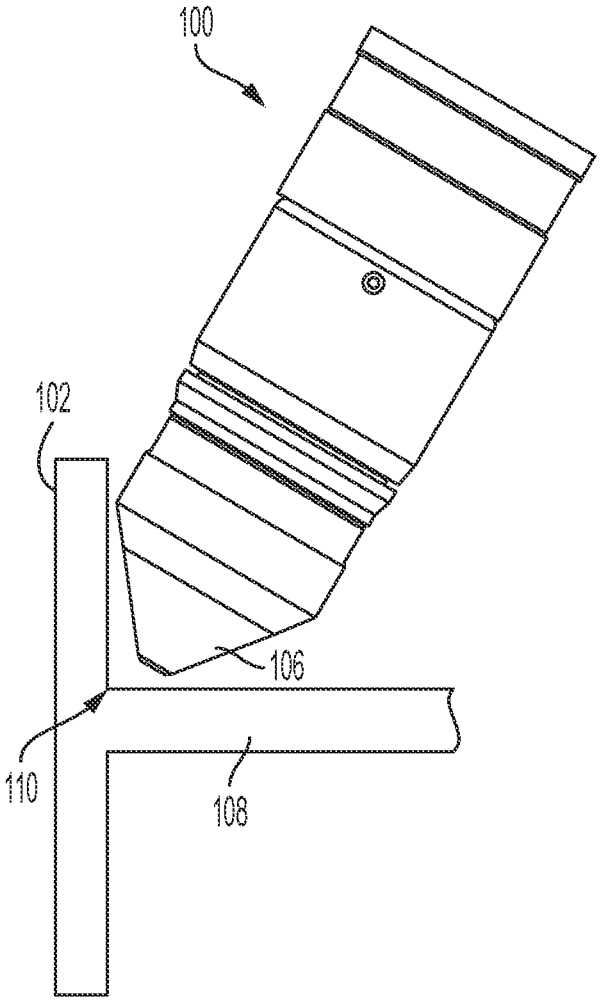
FIG. 1a PRIOR ART
FIGS. 1*a* and 1*b* show the positioning of a conventional plasma arc torch in relation to a vertical flange to be cut and the resulting cut made by the conventional plasma arc torch, respectively.
Figure 1B:
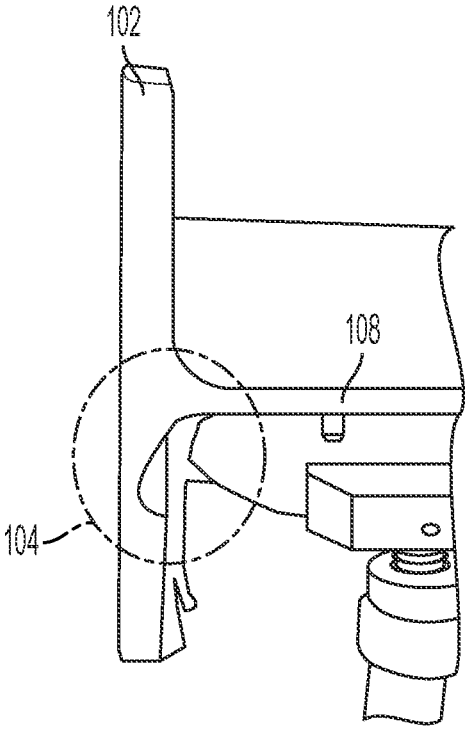
FIG. 1b PRIOR ART

In some embodiments, the diameter (D) 604 of the narrow tip portion of the extender 302 can be less than about 1 inch, such as about 0.8 inches. This means that the diameter of each the electrode holder 350, the swirl ring holder 352, the nozzle holder 354 and the shield holder 356 of the extender 302 along the entirety of the extended tip portion 602 (e.g., for greater than at least one inch in length) is less than about 1 inch. In some embodiments, the diameter 606 of the shield exit orifice 512 is about 0.2 inches. In addition, an angle 608 of the shield 322 can be about 60 degrees. This long and narrow distal portion 610 of the torch 300 allows the torch 300 to reach and operate in distant or hard-to-reach cutting zones and make cuts at steep angles that a conventional prior art torch cannot, such as the torch 100 of FIG. 1 or the torch 200 of FIG. 2.

Figure 2:
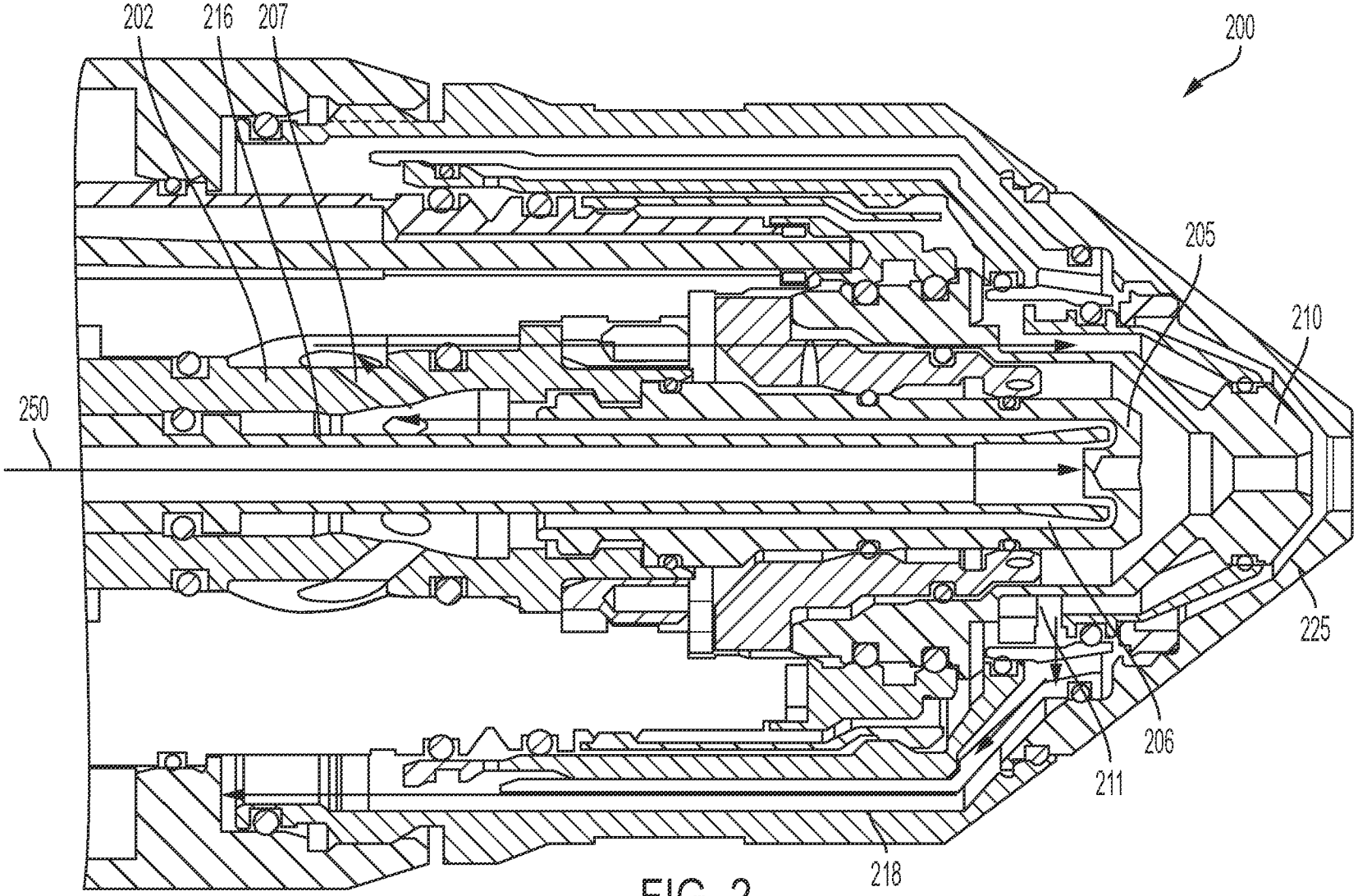
FIG. 2 PRIOR ART
FIG. 2 shows a known liquid cooling path in a conventional liquid-cool plasma arc torch.
Figure 7:
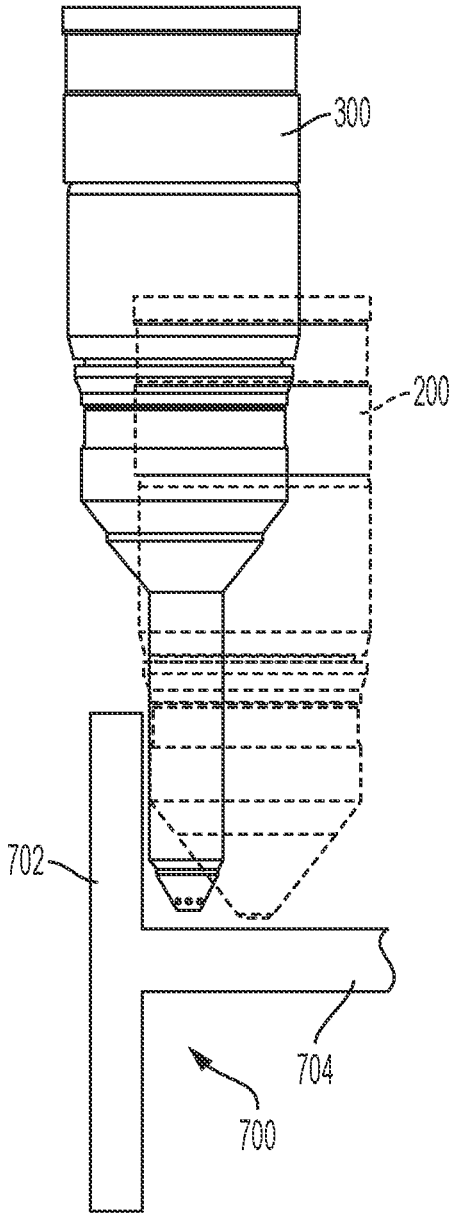
FIG. 7 shows a visual comparison of the plasma arc torch of FIG. 3 with the prior art torch of FIG. 2 when processing a flanged workpiece, according to some embodiments of the present invention.

FIG. 7 shows a visual comparison of the plasma arc torch 300 of FIG. 3 with the prior art torch 200 of FIG. 2 when processing a flanged workpiece 700, according to some embodiments of the present invention. As shown, the distal portion 610 of the plasma arc torch 300 is able to be positioned much closer to the vertical flange 702 of the workpiece 700 along the horizontal flange 704 than that of the conventional torch 200. Thus, the plasma arc torch 300 is able to cut the flange 702 from the workpiece 700 with minimal damage in comparison to the cut that can be made by the conventional torch 300.

Figures 8A, 8B, 8C:
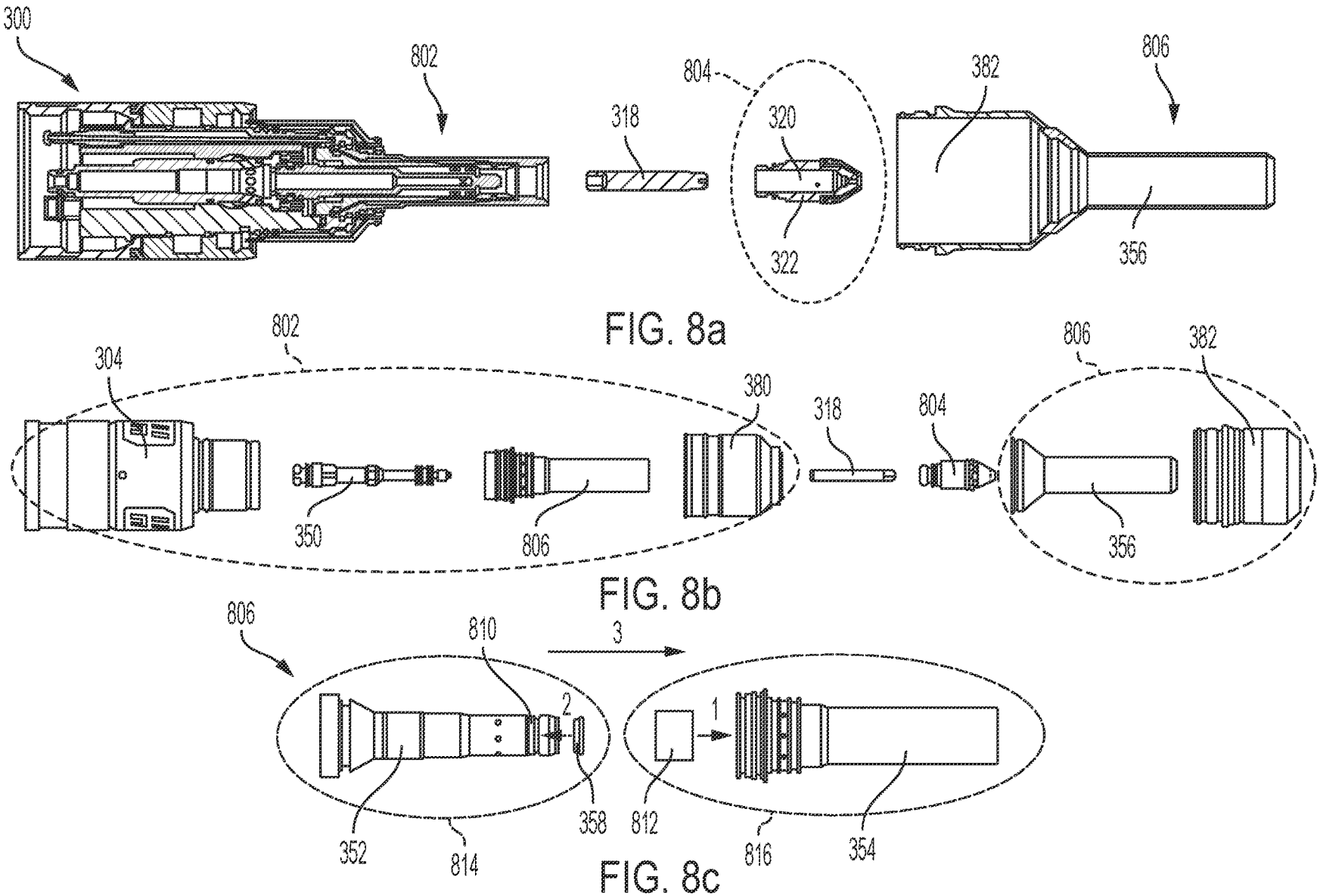
FIGS. 8*a*-8*c* show various stages of assembly of the plasma arc torch of FIG. 3, according to some embodiments of the present invention.

In yet another aspect, a method is provided for assembling the plasma arc torch 300 of FIG. 3. FIGS. 8*a*-8*c* show various stages of assembly of the plasma arc torch 300 of FIG. 3, according to some embodiments of the present invention. In general, as shown in FIG. 8*a*, the plasma arc torch 300 can be assembled in four parts, a proximal sub-assembly 802, the electrode 318, a central sub-assembly 804, and a distal sub-assembly 806. As shown in FIG. 8*b*, the proximal sub-assembly 802 includes the torch body 304, the electrode holder 350, a combination 806 of the swirl ring holder 352, the swirl ring 358 and the nozzle holder 354, and the inner retaining cap 380. Details for assembling the holder combination 806 is provided below with reference to FIG. 8*c*. To assemble the proximal sub-assembly 802, the electrode holder 350 is inserted into the hollow body of the holder combination 806 from its proximal end, such that the holder combination 806 substantially surrounds the electrode holder 350. The resulting combination of the electrode holder 350 and the holder combination 806 is then disposed into the inner retaining cap 380 from its proximal end such that the inner retaining cap 380 substantially surrounds an exterior section of the distal end of the holder combination 806. Thereafter, the resulting combination of the electrode holder 350, the holder combination 806 and the inner retaining cap 380 is attached to the proximal end of the torch body 304 to form the proximal sub-assembly 802. To assemble the central sub-assembly 804, the nozzle 320 is disposed into the hollow body of the shield 322 from the proximal end of the shield 322 such that the shield 322 substantially surrounds the nozzle 320 and is attached to the shield 322 via the insulator 360. To assemble the distal sub-assembly 806, the shield holder 356 is disposed into the outer retaining cap 382 from the distal end of the outer retaining cap 382 such that the outer retaining cap 382 substantially surrounds an exterior section of the distal end of the shield holder 356.

Referring back to FIG. 8*a*, to fully assembly the torch 300, the electrode 318 is coupled to the distal end of the proximal sub-assembly 802 such that a proximal portion of the electrode 318 is in threaded engagement with the electrode holder 352 in the sub-assembly 802. The central sub-assembly 804, which includes the nozzle 320 coupled to the shield 322 is then attached to proximal sub-assembly 802 by engaging the proximal end of the nozzle 320 of the central sub-assembly 804 with the distal end of the nozzle holder 354 of the proximal sub-assembly 802. This engagement allows the distal end of the electrode 318 to be suspended within the hollow body of the nozzle 320. Thereafter, to fully assembly the torch 300, the distal sub-assembly 806, which includes the outer retaining cap 382 and the shield holder 806, is attached to the torch body 304 of the proximal sub-assembly 802 such that the shield holder 354 substantially surrounds the nozzle holder 352 and the outer retaining cap 382 substantially surrounds the inner retaining cap 380. The outer retaining cap 382 retains the shield holder 806 to the proximal sub-assembly 802.

With reference to FIG. 8*c*, to form the holder combination 806 of the proximal sub-assembly 802, the swirl ring 358 is coupled to an outer circumference of the swirl ring holder 352 from the distal end of the swirl ring holder 352, where the swirl ring 358 can be held in place by a groove 810 etched into an exterior surface of the swirl ring holder 352. A nozzle insulator 812 can be disposed into the hollow body of the nozzle holder 354 such that the nozzle insulator 812 is coupled to an inner circumference of the nozzle holder 354. The nozzle insulator 812 is configured to electrically insulate/distance the conductive surfaces of the nozzle holder 354 and the electrode holder 350 through radial passages 364 to prevent arcing during operation (e.g., via the liquid coolant). To form the holder combination 806, the combination 814 of the swirl ring 358 and the swirl-ring holder 352 is coupled to the combination 816 of the nozzle insulator 812 and the nozzle holder 354 such that the nozzle holder 354 substantially surrounds the swirl ring holder 352 (and the swirl ring 358), with the nozzle insulator 812 sandwiched between the two components.

It should be understood that various aspects and embodiments of the invention can be combined in various ways. Based on the teachings of this specification, a person of ordinary skill in the art can readily determine how to combine these various embodiments. Modifications may also occur to those skilled in the art upon reading the specification.

What is claimed is:

1. A torch tip for a liquid-cooled plasma arc cutting torch, the torch tip comprising:

an electrode with an elongated electrode body having a distal end and a proximal end extending along a longitudinal axis, the electrode body including a bore at the distal end for receiving a hafnium insert and at least one interior threaded connection at the proximal end for engaging a liquid-cooled electrode holder, wherein the electrode holder comprises a liquid coolant channel that does not extend into the electrode body, the electrode body having (i) a length extending along the longitudinal axis and (ii) a diameter associated with a widest portion of the electrode body along the longitudinal axis between the proximal and distal ends, wherein a ratio of the length to the diameter of the electrode body is greater than 5;

a nozzle including a substantially hollow, elongated nozzle body for receiving the electrode, the nozzle body defining (i) a length extending along the longitudinal axis and (ii) a diameter associated with a widest portion of the nozzle body along the longitudinal axis, wherein a ratio of the length to the diameter of the nozzle body is greater than 1.75; and a shield coupled to the nozzle via an insulator, wherein the shield includes:

a set of radially-oriented passages dispersed around a first circumference of the shield, the radially-oriented passages fluidly connecting an exterior surface to an interior surface of the shield and configured to impart a swirling motion on a first portion of a combined gas flow therethrough, and a set of axially-oriented passages dispersed around a second circumference of the shield, the axially-oriented passages configured to axially conduct a second portion of the combined gas flow over an external surface of the shield.

2. The torch tip of claim 1, wherein the diameter of the electrode is less than 0.25 inches.

3. The torch tip of claim 1, wherein the at least one threaded connection is configured to engage a complementary threaded connection on an external surface of the electrode holder, such that a distal portion of the electrode holder is disposed in a cavity of the electrode body upon engagement.

4. The torch tip of claim 3, wherein the cavity within the electrode body is shaped and sized to substantially surround a protruding boss portion at the distal portion of the electrode holder, thereby axially and radially aligning the electrode relative to the electrode holder.

5. The torch tip of claim 1, wherein the ratio of the length to the diameter of the electrode body is greater than 7.

6. The torch tip of claim 1, wherein the set of axially-oriented passages of the shield comprises at least one groove disposed on the exterior surface of the shield.

7. The torch tip of claim 1, wherein the combined gas flow comprises a combination of a plasma gas flow and a shield gas flow.

8. The torch tip of claim 7, wherein the nozzle comprises a set of radially-oriented passages each connecting an interior surface of the nozzle body to an exterior surface of the nozzle body, the set of radially-oriented passages of the nozzle configured to fluidly communicate with the radially-oriented and axially-oriented passages of the shield to supply a portion of the plasma gas flow to the shield.

9. The torch tip of claim 7, wherein the torch tip, including the electrode, the shield and the nozzle, is substantially cooled by at least one of the plasma gas flow, the shield gas flow or the combined gas flow without being cooled by a liquid coolant in the liquid coolant channel of the electrode holder.

* * * * *